United States Patent [19]

Lilley et al.

[11] 4,145,979

[45] Mar. 27, 1979

[54] AFTERBURNER ASSEMBLY

[75] Inventors: Frank Lilley, Palo Alto; Harold E. Foy, Menlo Park, both of Calif.

[73] Assignee: Envirotech Corporation, Menlo Park, Calif.

[21] Appl. No.: 871,309

[22] Filed: Jan. 23, 1978

[51] Int. Cl.[2] ..... F23J 5/04

[52] U.S. Cl. ..... 110/210; 110/214; 110/225; 110/254; 422/176; 432/72

[58] Field of Search ..... 110/225, 210, 214, 254, 110/211, 203, 243; 432/72, 233, 235, 239; 422/176

[56] References Cited

U.S. PATENT DOCUMENTS

| | | | |
|---|---|---|---|
| 2,136,451 | 11/1938 | Martin | 110/254 |
| 2,181,190 | 11/1939 | Lewers | 110/225 |
| 2,187,201 | 1/1940 | Hartley et al. | 110/225 |
| 2,744,477 | 5/1956 | Hartley et al. | 432/72 |
| 3,456,603 | 7/1969 | Studler | 110/214 |
| 4,013,023 | 3/1977 | Lombana et al. | 110/225 |
| 4,023,508 | 5/1977 | Cantrell, Jr. et al. | 110/243 |

FOREIGN PATENT DOCUMENTS

| | | | |
|---|---|---|---|
| 957906 | 11/1974 | Canada | 110/210 |

*Primary Examiner*—Henry C. Yuen

*Attorney, Agent, or Firm*—William S. Bernheim; Robert E. Krebs

[57] ABSTRACT

A burner assembly for combusting pyrolysis gases includes a chamber, a first cone-shaped conduit connected at its larger end to the chamber and a second conduit mounted to extend through the smaller end of the first conduit to have an open end positioned in the interior of the first conduit. Further, a conical baffle is mounted within the first conduit to have its apex adjacent the open end of the second conduit and a duct means is mounted to the first conduit for admitting air into the first conduit.

8 Claims, 3 Drawing Figures

AFTERBURNER ASSEMBLY

BACKGROUND

1. Field of the Invention

The invention relates in general to a burner for combusting gaseous fuels.

2. State of the Art

It is known to produce charcoal by pyrolyzing wood chips under a reducing atmosphere (oxygen deficient) in a multiple hearth furnace. This pyrolysis produces gases which are not completely combusted. To recapture the heat content of these pyrolysis gases, the gases have been passed to an afterburner to complete combustion of the gases and from the afterburner passed to a heat exchanger.

Heretofore, this approach to recapturing the heat content of pyrolysis gases has not been entirely satisfactory. Afterburners have commonly allowed uncombusted gases to pass through to the heat exchanger. Such uncombusted gases cause damage to the heat exchanger by providing a reducing atmosphere which is conducive to corrosion in the heat exchanger and by allowing combustion, which results in overheating, to occur in the heat exchanger.

In addition, these afterburners have typically employed small diameter orifices and passages to convey the pyrolysis gases to achieve good mixing of the pyrolysis gases with oxygen which is needed to combust the gases. These small orifices and passages are undesirable because of possible clogging by particulates carried in the gases.

OBJECTS OF THE INVENTION

An object of this invention is to provide a burner with which to complete combustion of pyrolysis gases produced in a multiple hearth furnace. Another object is to provide a burner achieving good mixing of pyrolysis gases with oxygen without conveying the pyrolysis gases through small orifices or passages.

BRIEF DESCRIPTION OF THE DRAWINGS

Further objects and advantages of the invention may be readily ascertained by reference to the following description and appended drawings, which are offered by way of description only and not in limitation of the invention, the scope of which is defined in the appended claims.

In the drawings.

PREFERRED EMBODIMENT OF THE INVENTION

Figure 2:
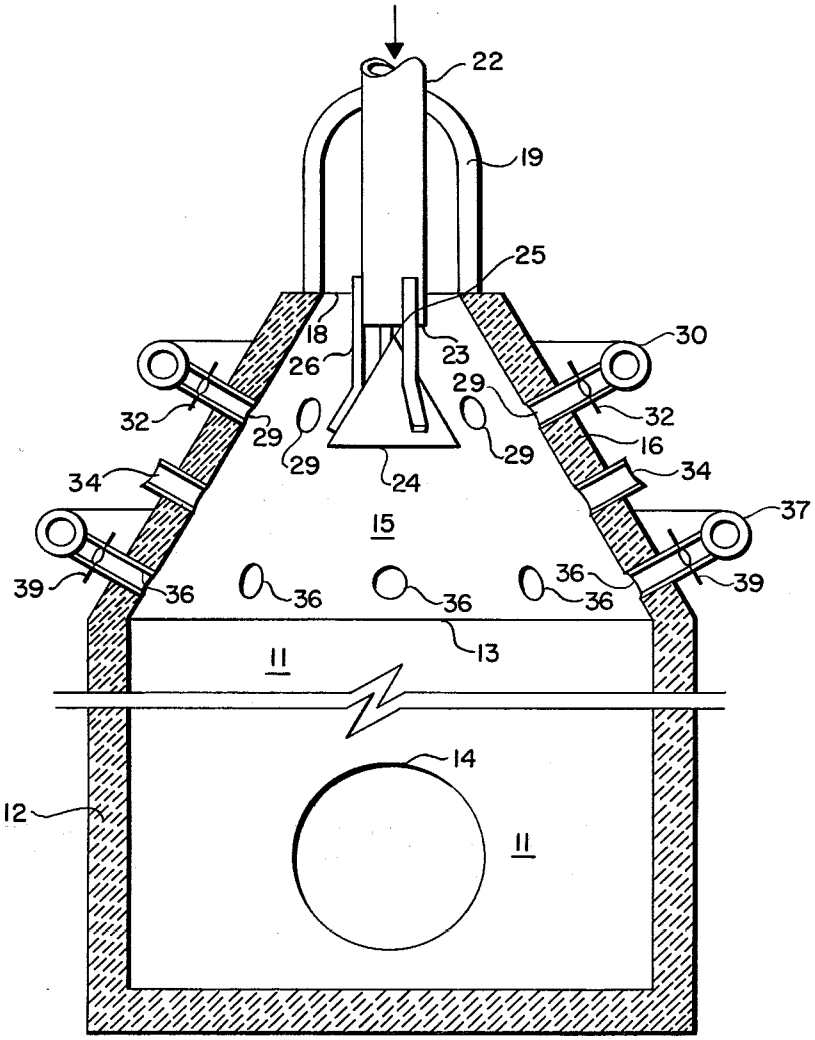
FIG. 2 is a sectional view of the burner of FIG. 1 taken along the line 2—2 for viewing in the direction of the arrows.
Figure 1:
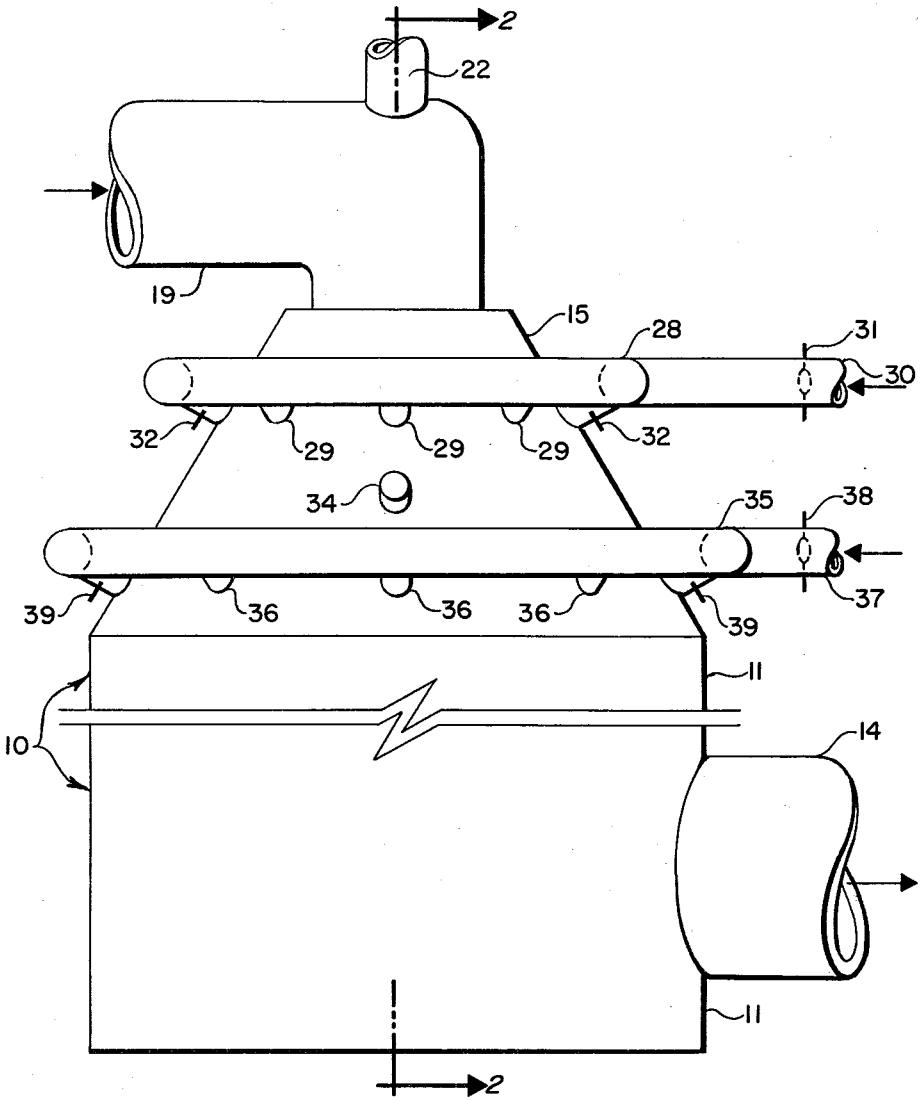
FIG. 1 is a side view of a burner according to the present invention.

As shown in FIGS. 1 and 2, a burner assembly 10 for combusting gaseous fuels includes a chamber 11 lined with refractory 12 and having an open inlet end 13 and an outlet 14. The outlet 14 can be located at the opposite end of the chamber 11 from the open inlet end 13, but, is preferably mounted at an angle of about ninety degrees with respect to open inlet end 13.

The assembly 10 also incorporates a first conduit 15, lined with refractory 16 and shaped like a truncated hollow cone to have a larger circular end 13 and a spaced-apart smaller circular end 18. The larger circular end 13 is connected in gas flow communication to the inlet end 13 of the chamber 11. Preferably the first conduit 15 is located vertically above the chamber 11 so that the open inlet end 13 is above the open outlet 14. A gas duct 19 is connected to the smaller circular end 18 for admitting a gas stream to the chamber 11.

A cylindrical second conduit 22 is connected in gas flow communication to the smaller end 18 of the first conduit 15 and mounted to extend concentrically through the smaller end 18 to have an open circular end 23 positioned in the interior of the first conduit 15 to admit a first air stream to the chamber 11. Preferably, the second conduit 22 is slideably mounted so that the position of the open circular end 23 within the first conduit 15 along the axis on which the second conduit 22 extends into the first conduit 15 can be changed in order to adjust the combustion characteristic of the burner assembly 10.

Within the first conduit 15 a conical baffle 24 is mounted to have its apex 25 adjacent the open end 23 of the second conduit 22. The surface of the baffle 24 diverges outward from the apex 25 equal distance from an axis which is an extension of the cylindrical axis of the second conduit 22. Bars 26 mount the conical baffle 24 to the second conduit 22 at the open end 23.

The first conduit 15 is encircled by a bustle main 28 mounted adjacent the smaller end 18. A plurality of nozzles 29 are spaced along the bustle main 28 to interconnect in gas flow communication the bustle main 28 and the interior of the first conduit 15. Through these nozzles 29 a second air stream is admitted into the first conduit 15 to mix with the gas stream admitted through duct 19 and the first air stream admitted through second conduit 22. The nozzles 29 extend through the sidewall of the first conduit 15 at an angle to the sidewall which is approximately perpendicular. The second air stream enters the bustle main 28 through an air duct 30 connected to the bustle main 28. The flow of the second air stream is controlled by butterfly dampers 31 and 32, mounted in the air duct 30 and nozzles 29 respectively.

Apertures 34 through the wall of first conduit 45 provide means for mounting pilot burners. The apertures 34 are formed in the first conduit 15 between the bustle main 28 and the open end 13 of the chamber 11.

A second bustle main 35 is mounted to encircle the first conduit 15 adjacent the larger end 13. A plurality of nozzles 36 are spaced along the bustle main 35 to interconnect in gas flow communication the bustle main 35 and the interior of the first conduit 15. The cooling air stream enters the bustle main 35 through an air duct 37 connected to the bustle main 28. To control the flow of the cooling air stream, butterfly dampers 38 and 39 are mounted in the air duct 37 and nozzles 36, respectively.

Figure 3:
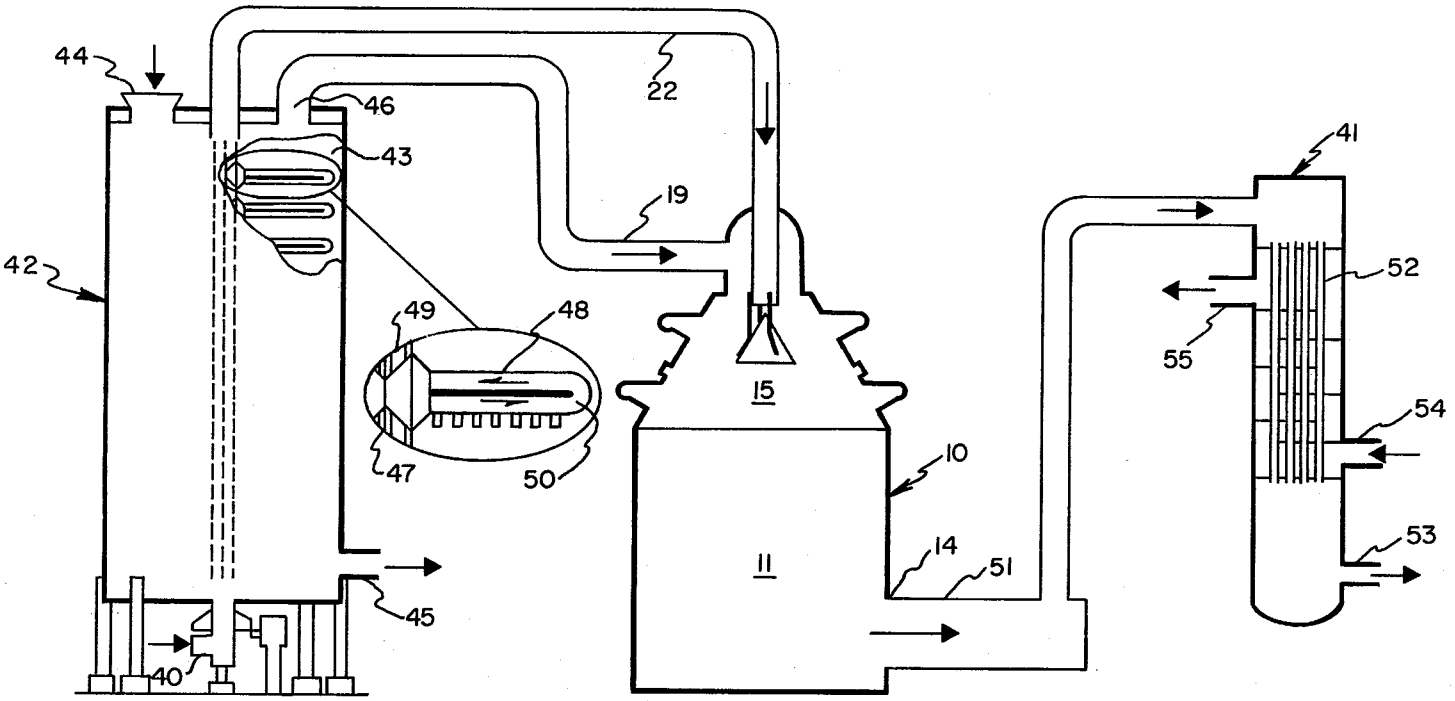
FIG. 3 is a pictorial schematic of a pyrolysis gas system employing the burner of FIG. 1.

FIG. 3 is a pictorial schematic of a heat recovery system which includes the burner assembly 10, a heat exchanger 41 and a multiple hearth furnance 42. The multiple hearth furnace 42 includes a furnace chamber 43 having an inlet 44 for admitting feed, a first outlet 45 for discharging solids, and a second outlet 46 for discharging gases. The second outlet 46 is connected in flow communicaton to duct 19.

Mounted in the furnace chamber 43 is a central shaft 47 supporting a plurality of rotatable arms 48. A cooling system for circulating air for cooling the shaft 47 and the arms 48 includes a conduit 49 extending in the shaft 47 and passages 50 in the arms connected to the conduit 49. Air for cooling is admitted to conduit 49 through an inlet 40 located at the bottom of the furnace 42. Following circulation the air is discharged from the conduit 49 to the second conduit 22 of the assembly 10.

The outlet 14, of the assembly 10 is connected in flow communication by a duct 51 to the heat exchanger 41. The heat exchanger 41 can be any of many known direct and indirect, co-current and counter-current type heat exchangers. The heat exchanger 41 shown in FIG. 3 is of a indirect counter-current type. The hot gases from the assembly 10 enter tubes 52 of the heat exchanger 41 from duct 51 and are discharged through duct 53. A gas, such as air, to be heated enters the heat exchanger through duct 54 and is discharged through duct 55.

In operation, a gas stream containing fuel, such as the gases from the multiple hearth furnace 42 being operated in a pyrolysis mode, is delivered to the chamber 11 of assembly 10 through duct 19. Upon entering the smaller end 18 of the first conduit 15, this gas stream is in the form of an annulus surrounding the second conduit 22. A first air stream, such as the heated cooling shaft air from the multiple hearth furnace 42, containing oxygen to be mixed with the gas stream to allow combustion is delivered to the chamber 11 through the second conduit 22 at the open end 23. Upon exiting through the open end 23, this first air stream contacts the baffle 24 and assumes a diverging conical flow pattern over the baffle 24 similar to the conical shape of first conduit 15. This diverging pattern produces a confluence of the first air stream with the gas stream. A second air stream containing additional oxygen to be mixed with the gas stream is admitted to the chamber 11 through nozzles 29 with a converging conical flow pattern. This latter flow pattern produces a confluence of the second air stream with gas stream and first air stream adjacent the downstream end of the baffle 24 to provide a combustible mixture of gases. Self-sustaining combustion can be established. Pilot burners mounted in aperatures 34 provide initial heat and ignition for combustion. After combustion the gases are discharged through outlet 14 and delivered to the heat exchanger 41.

If needed, cooling can be provided in the assembly 10 by introducing air through nozzles 36 to prevent temperatures above those the assembly 10 can withstand.

The burner assembly 10 has several desirable characteristics. The assembly 10, without the utilization of small orifices or small passages, achieves good mixing of gases. Further, the assembly 10 minimizes the possibility of additional combustion occurring downstream of the assembly 10. Even further, the orientation of the outlet 14 at an angle to the inlet 13 facilitates departure of heavy particles from the combusted gases to prevent their escape to the atmosphere downstream of the assembly 10.

We claim:

1. An assembly for combusting pyrolysis gases which comprises:

a. a chamber having an open inlet end and an open outlet;

b. a first conduit shaped like a truncated hollow cone and connected in gas flow communication, at its larger end, to said inlet end of said chamber for admitting a gas stream to said chamber;

c. a cylindrical second conduit connected in gas flow communication with said first conduit and mounted to extend through the smaller end of said first conduit to have an open end positioned in the interior of said first conduit to admit a first air stream to said chamber;

d. a conical baffle mounted within said first conduit and having its apex adjacent said open end of said second conduit so that the first air stream upon exiting said open end of said second conduit diverges over said baffle with a conical flow pattern; and e. duct means mounted to admit a second air stream into said first conduit and positioned so that the second air stream upon admission, converges with the first air stream.

2. An assembly according to claim 1 wherein said first conduit and second conduit are coaxially mounted at said smaller end of said first conduit so that the gas stream enters said smaller end as an annulus of flow about the exterior of said second conduit.

3. An assembly according to claim 1 wherein said conical baffle is mounted to said second conduit.

4. An assembly according to claim 1 further including a second duct means mounted in gas flow communication with said chamber to admit additional air downstream of said first duct means.

5. An assembly according to claim 1 wherein said outlet of said chamber is oriented at an angle of about ninety degrees with respect to said inlet of said chamber.

6. A heat recovery system for recovering the heat content of pyrolysis gases generated in a multiple hearth furnace, said system comprising:

a. an afterburner including:

i. a chamber having an open inlet end and an open outlet;

ii. a first conduit shaped like a truncated hollow cone and connected in gas flow communication, at its larger end, to said inlet end of said chamber for admitting a gas stream to said chamber;

iii. a cylindrical second conduit connected in gas flow communication with said first conduit and mounted to extend through the smaller end of said first conduit to have an open end positioned in the interior of said first conduit to admit a first air stream to said chamber;

iv. a conical baffle mounted within said first conduit and having its apex adjacent said open end of said second conduit so that the first air stream upon exiting said open end of said second conduit diverges over said baffle with a conical flow pattern; and v. duct means mounted to admit a second air stream into said first conduit and positioned so that the second air stream, upon admission, converges with the first air stream; and b. a multiple hearth furnace including a chamber having a feed inlet, a solids outlet and a gas outlet; a central shaft mounted in said chamber, a plurality of rotatable arms mounted within said chamber and supported from said central shaft; and means for delivering the exhaust gases from said gas outlet of said furnace to said smaller end of said first conduit of said afterburner.

7. A heat recovery system according to claim 6 further including an air cooling system having means for circulating air in said central shaft and plurality of arms for cooling and including means for delivering the air from said air cooling system after circulation to said second conduit of said afterburner.

8. A heat recovery system according to claim 6 further including a heat exchanger and means for delivering gases from said open outlet of said afterburner to said heat exchanger.

* * * * *